US008371115B2

(12) United States Patent
Sloss et al.

(10) Patent No.: US 8,371,115 B2
(45) Date of Patent: Feb. 12, 2013

(54) EXHAUST COMPONENT ASSEMBLIES WITH DIVIDER PLATES

(75) Inventors: Clayton A. Sloss, Paris (CA); Richard T. Snowdon, St. Williams (CA); Paul L. Pickard, Wilsonville (CA)

(73) Assignee: Wescast Industries, Inc., Brantford, ON (CA)

( * ) Notice: Subject to any disclaimer, the term of this patent is extended or adjusted under 35 U.S.C. 154(b) by 750 days.

(21) Appl. No.: 12/509,999

(22) Filed: Jul. 27, 2009

(65) Prior Publication Data

US 2010/0005793 A1 Jan. 14, 2010

Related U.S. Application Data

(63) Continuation-in-part of application No. 11/151,681, filed on Jun. 13, 2005, now Pat. No. 7,565,800.

(51) Int. Cl.
*F01N 3/10* (2006.01)

(52) U.S. Cl. ..... 60/324; 60/313; 60/323

(58) Field of Classification Search ..... 60/313, 60/323, 324
See application file for complete search history.

(56) References Cited

U.S. PATENT DOCUMENTS

| | | | | |
|---|---|---|---|---|
| 3,768,260 | A | 10/1973 | Glenn | |
| 4,084,658 | A | 4/1978 | Murphy | |
| 4,790,134 | A | 12/1988 | Johnson | |
| 4,796,426 | A * | 1/1989 | Feuling | 60/313 |
| 4,815,274 | A * | 3/1989 | Piatti | 60/313 |
| 5,148,675 | A * | 9/1992 | Inman | 60/321 |
| 5,284,016 | A * | 2/1994 | Stark et al. | 60/303 |
| 6,918,246 | B2 * | 7/2005 | Fukumoto et al. | 60/323 |
| 7,028,663 | B1 * | 4/2006 | Kim | 123/306 |
| 7,252,177 | B2 * | 8/2007 | Minato | 60/323 |
| 7,503,171 | B2 * | 3/2009 | Saito | 60/323 |
| 2002/0040579 | A1 * | 4/2002 | Furudate | 60/324 |
| 2006/0053782 | A1 | 3/2006 | Kobayashi et al. | |

FOREIGN PATENT DOCUMENTS

| | | |
|---|---|---|
| EP | 0686758 A1 | 12/1995 |
| EP | 1734235 A1 | 12/2006 |
| FR | 2875266 A1 | 3/2006 |

OTHER PUBLICATIONS

International Search Report and Written Opinion of the International Searching Authority regarding Application No. PCT/IB2010/001861 dated Dec. 6, 2010.

* cited by examiner

*Primary Examiner* — Thomas Denion
*Assistant Examiner* — Diem Tran
(74) *Attorney, Agent, or Firm* — Harness, Dickey & Pierce, PLC

(57) ABSTRACT

A exhaust component assembly includes an exhaust component and a divider plate. The exhaust component includes an inner wall defining a gas passageway. The divider plate is inserted in the gas passageway and secured to the exhaust component by mechanical locking means, generally in an interference-fit relationship.

19 Claims, 13 Drawing Sheets

EXHAUST COMPONENT ASSEMBLIES WITH DIVIDER PLATES

CROSS-REFERENCE TO RELATED APPLICATION

This application is a continuation-in-part of U.S. patent application Ser. No. 11/151,681, filed on Jun. 13, 2005. The disclosure of the above application is incorporated herein by reference.

FIELD

The present disclosure generally relates to exhaust components, such as exhaust manifolds, turbochargers, or catalytic converters, and more particularly to exhaust component assemblies employing press-fit divider plates to protect the exhaust components from thermal damage.

BACKGROUND

The background description provided herein is for the purpose of generally presenting the context of the disclosure. Work of the presently named inventors, to the extent that it is described in this background section, as well as aspects of the description that may not otherwise qualify as prior art at the time of filing, are neither expressly nor impliedly admitted as prior art against the present disclosure.

Exhaust components, such as exhaust manifolds, turbochargers, and catalytic converters are provided downstream from engines to direct and guide exhaust gas flow for further treatment or use and are subject to high temperature. Exhaust manifolds are commonly made from cast iron for high volume production engines. Among the commonly used cast iron material for the exhaust manifolds is silicon-molybdenum cast iron ("SiMo cast iron"). SiMo cast iron becomes weaker as the temperature increases. As a result, the SiMo cast iron is subject to damage from oxidation, decarburization, and coarsening. The duration of time at high temperature determines the amount of material damage that accumulates. The accumulation of damage and the elevated temperature strength (the thermal strength) of the material are important factors in evaluating durability of the exhaust component.

As automotive companies increase the gas temperatures of their engines to improve efficiency and reduce exhaust emissions, more manifold applications are exceeding the practical working (temperature) limit of cast iron. The temperature distribution in the manifolds is not uniform and some peak temperature areas receive more heat than other areas in the manifolds. SiMo (silicon-molybdenum) cast iron exhaust manifolds have an AC1 temperature of approximately 830-840° C. The AC1 temperature is the temperature at which the ferritic microstructure starts to be converted into austenite. Since a typical maximum gas temperature of the manifold outlet for a current North American gasoline engine is about 900° C., it can be shown that most areas of the manifold will be below the AC1 temperature.

Currently, if a material such as cast iron is inadequate for the peak temperature, the entire manifold has to be made from a higher grade material (e.g., Ni-Resist, cast steel, or fabricated stainless steel). Therefore, the manufacturing costs for exhaust manifolds for high temperature applications are significantly increased.

Single material cast exhaust components can suffer severe damage in regions of local high temperature and large thermal gradients such as the outlet or along the bifurcation. The high temperature promotes oxidation and the thermal gradients introduce local strains that may make the oxide layer less adherent. If spalling of the oxide occurs, particles are released into the exhaust gas stream that may bombard and damage downstream components such as turbochargers and catalytic converters.

The oxidation, particle coarsening, and decarburization that occurs locally in the high temperature regions can significantly degrade the local material properties over time. This may result in premature cracking and warpage, both of which can reduce component durability performance. These effects, in turn, may result in exhaust gases leaking to the environment (through a crack or loss of sealing) or allow exhaust gas to communicate (travel) between separated runners or chambers (either will negatively influence system performance). If large thermally induced strains are co-located with the manifold areas with degraded material properties, component failure by cracking is common.

SUMMARY

An exhaust component assembly according to the present disclosure includes an exhaust component and a press-fit divider plate. The exhaust component includes an inner wall defining a gas passageway. The divider plate is inserted into the gas passageway and secured to the exhaust component.

An exhaust component assembly includes an inlet portion, and outlet portion, runners connected between the inlet portion and the outlet portion, and at least one divider plate. Depending on the embodiment, at least one of the inlet portions or outlet portions include an inner wall which defines a gas passageway. At least one groove is formed on the inner wall for receiving a divider plate which segregates the gas passageway into at least two distinct chambers. At least one of the divider plate or groove includes mechanical features for locking the divider plate to groove walls that define the groove.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DESCRIPTION OF THE DRAWINGS

The drawings described herein are for illustration purposes only and are not intended to limit the scope of the present disclosure in any way.

DESCRIPTION

Figure 1:
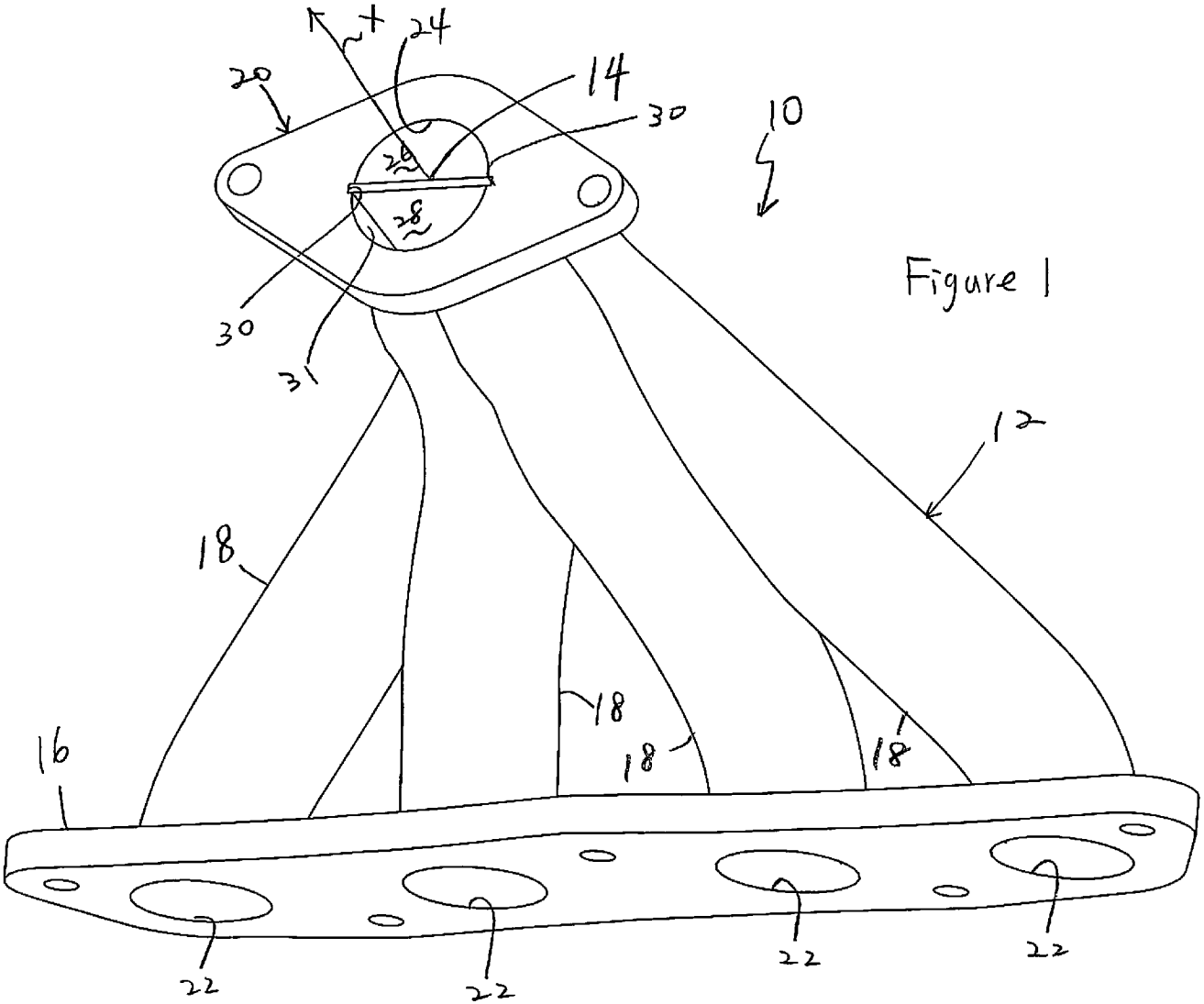
FIG. 1 is a perspective view of an exhaust manifold employing a press-fit divider plate in accordance with the teachings of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, an exhaust assembly 10 includes an exhaust component 12 and a divider plate 14. The exhaust component 12 as shown in FIG. 1 is an exhaust manifold, which includes an inlet portion 16, a plurality of runners 18 extending from the inlet portion 16, and an outlet portion 20. The inlet portion 16 is connected to an engine block (not shown) and defines a plurality of inlet ports 22. The runners 18 define flow channels (not shown) that communicate with the inlet ports 22. The outlet portion 20 defines a gas passageway 24. The flow channels of the runners 18 converge into the gas passageway 24. The divider plate 14 is provided across the passageway 24 and installed to the outlet portion 20 along a longitudinal direction X of the passageway 24 (i.e., the flow direction of the exhaust gas flow) to divide the passageway 24 into a first chamber 26 and a second chamber 28.

It is understood and appreciated that while the exhaust component is shown as an exhaust manifold in FIG. 1, the exhaust component may be any component in an exhaust system having a passageway to guide and direct exhaust gas flow from an engine. For example, the exhaust component may be an exhaust manifold, a turbocharger, an inlet of a turbocharger, or an outlet portion of a combined cylinder head having an integral manifold portion.

The divider plate 14 is formed from a high temperature capable material with desired mechanical properties at elevated temperatures such as strength, microstructural stability, and/or oxidation resistance, by way of non-limiting examples. For example, the divider plate 14 may be formed of a material capable of accommodating significant thermal loads, such as stainless steel and/or ceramics. The divider plate 14 may be coated with materials, including but not limited to refractory materials, to enhance these properties. The divider plate 14 is resistant to degradation caused by thermal cycling and the like.

The highest (steady state) material temperatures are generally in the region of the outlet portion 20 of the exhaust component 12. With the divider plate 14 in the passageway 24, the divider plate 14 can absorb part of heat released from the exhaust gas. Therefore, the exhaust component 12 may be formed from lower grade cast iron materials, by way of non-limiting example.

The divider plate 14 can be readily installed to the outlet portion 20 in an interference-fit (i.e., press-fit) manner. More specifically, the divider plate 14 is inserted into a groove 30 formed on an inner wall 31 of the outlet portion 20 that defines the gas passageway 24. The divider plate 14 may include mechanical features to allow for quick fit in the grooves 30. The mechanical features are designed to allow for an interference fit relationship with the exhaust component, particularly with the groove 30 walls, thereby enabling the divider plate 14 to be locked in the outlet portion 20.

For example, the divider plate 14 may be specially shaped or be provided with locking tabs, dovetail, or tapering geometry to hold the divider plate 14 in place to prevent rattling or vibration/movement issues such as NVH problems. When the divider plate 14 is locked in the groove 30, the divider plate 14 is prevented from falling out during shipping and assembly. Optionally, the divider plate 14 may be provided with a thin refractory coating to prevent strong adhesion between the cast material of the exhaust component 12 and the divider plate to allow for periodic replacement of the divider plate.

The divider plate 14 is elastically deformable to absorb loads generated during mounting of the divider plate 14 in the exhaust component 12. As such, minimal loads are transferred to the exhaust component 12 when the divider plate 14 is inserted into the grooves 30, thereby avoiding damage to the groove walls.

Figure 2:
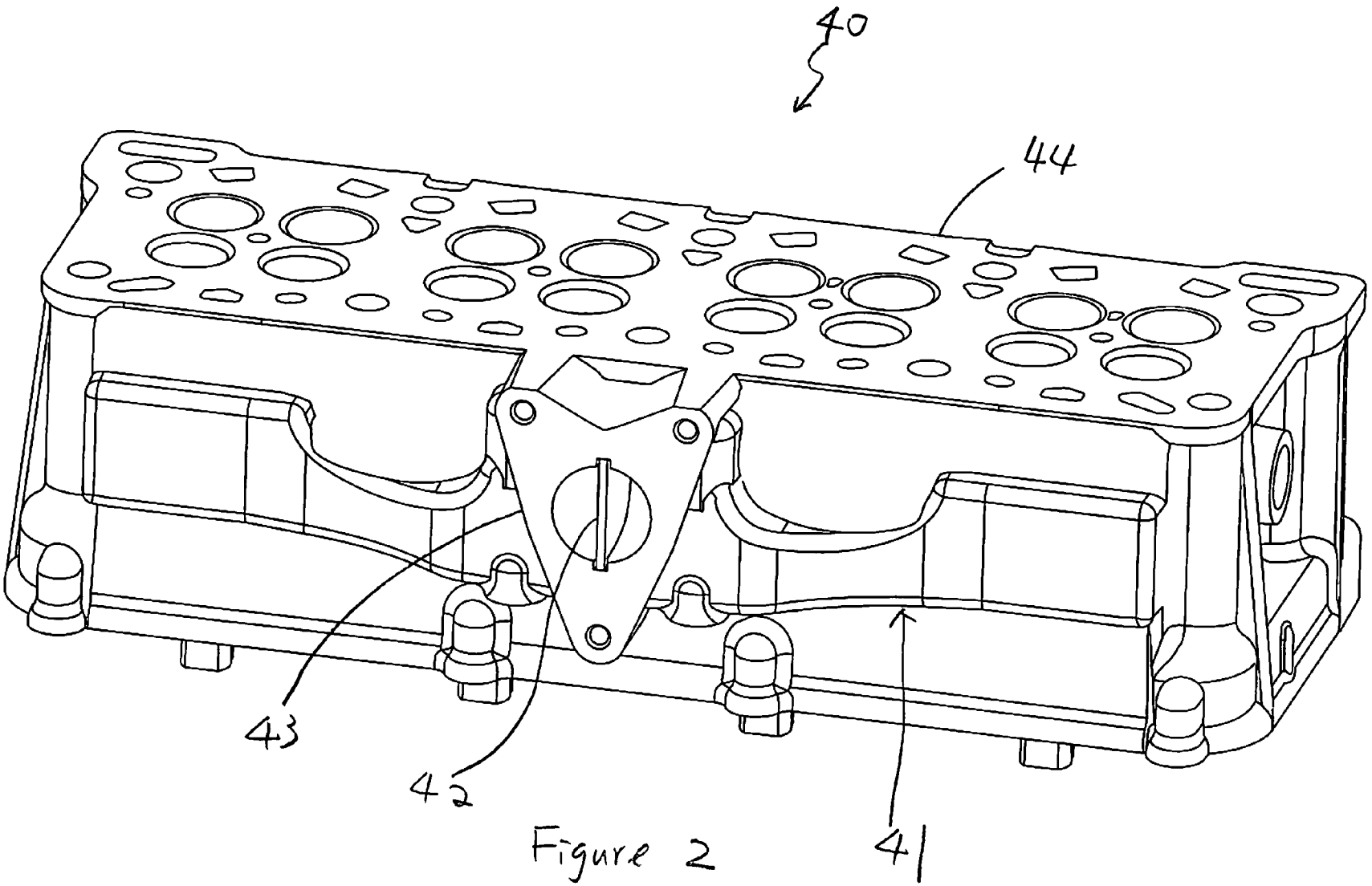
FIG. 2 is a perspective view of an exhaust manifold employing a press-fit divider plate and an engine block integrally formed with the exhaust manifold in accordance with the teachings of the present disclosure.

Referring to FIG. 2, an exhaust component assembly 40 may include an exhaust manifold 41, a divider plate 42 removably inserted in an outlet portion 43 of the exhaust manifold 41, and a cylinder head 44. The exhaust manifold 41 is integrally formed with the cylinder head 44. For example, the exhaust manifold 41 and the cylinder head 44 may be cast in one casting process.

Figure 3:
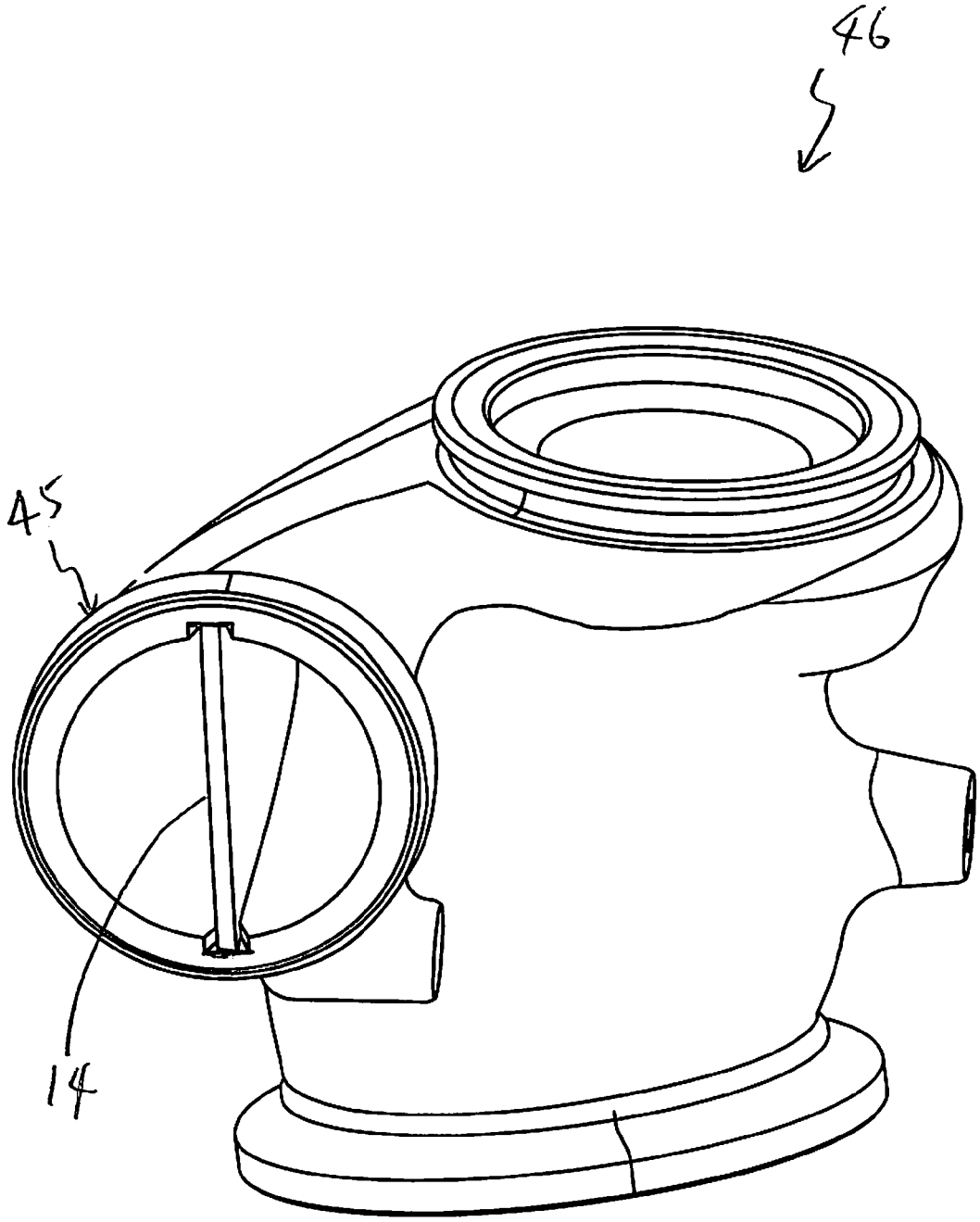
FIG. 3 is a perspective view of an inlet portion of a turbocharger employing a press-fit divider plate according to the teachings of the present disclosure.

Referring to FIG. 3, the exhaust component is shown to be an inlet portion 45 of a turbocharger 46. The divider plate 14 is incorporated in the inlet portion 45 of the turbocharger 46.

Figure 4:
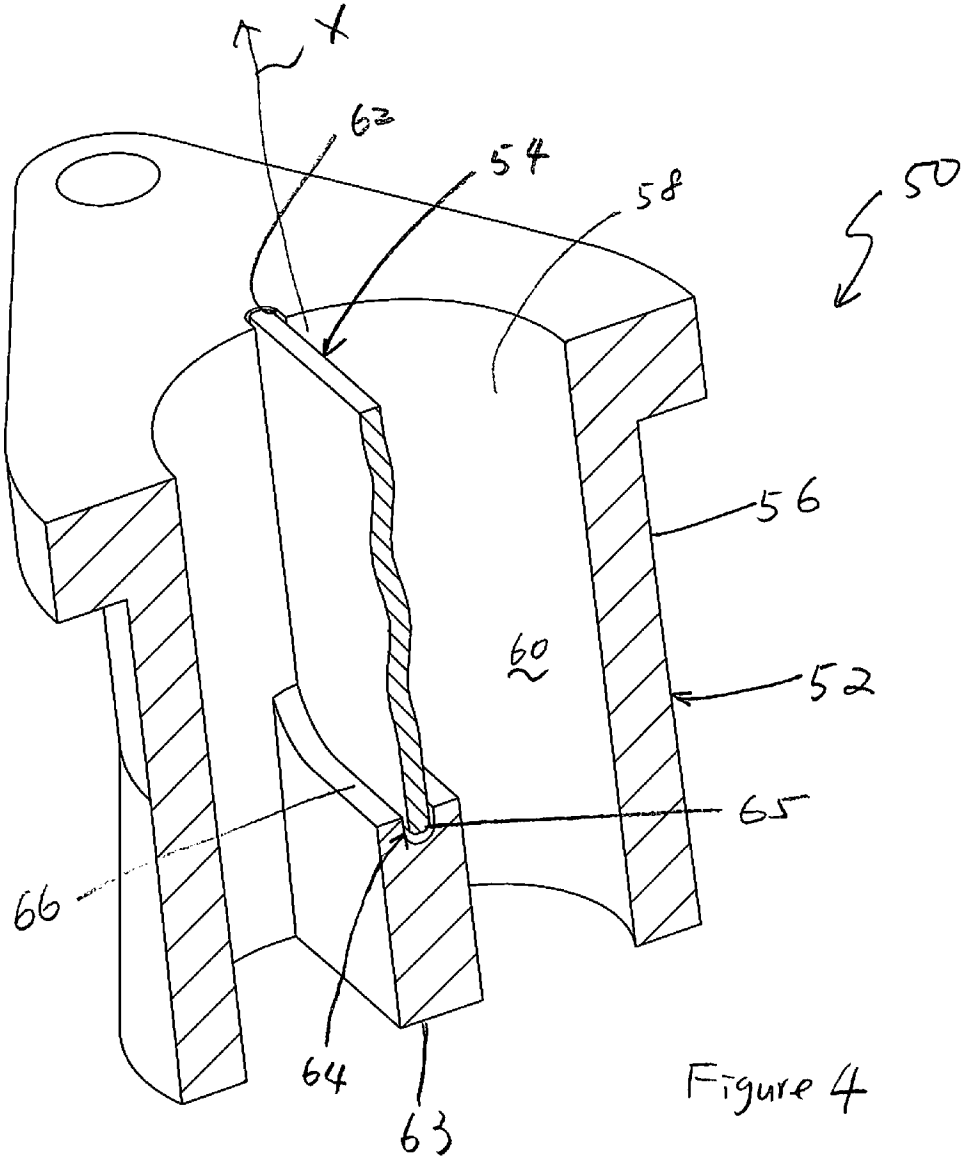
FIG. 4 is a perspective, cross-sectional view of an exhaust component assembly according to a first embodiment of the present disclosure.
Figure 5:
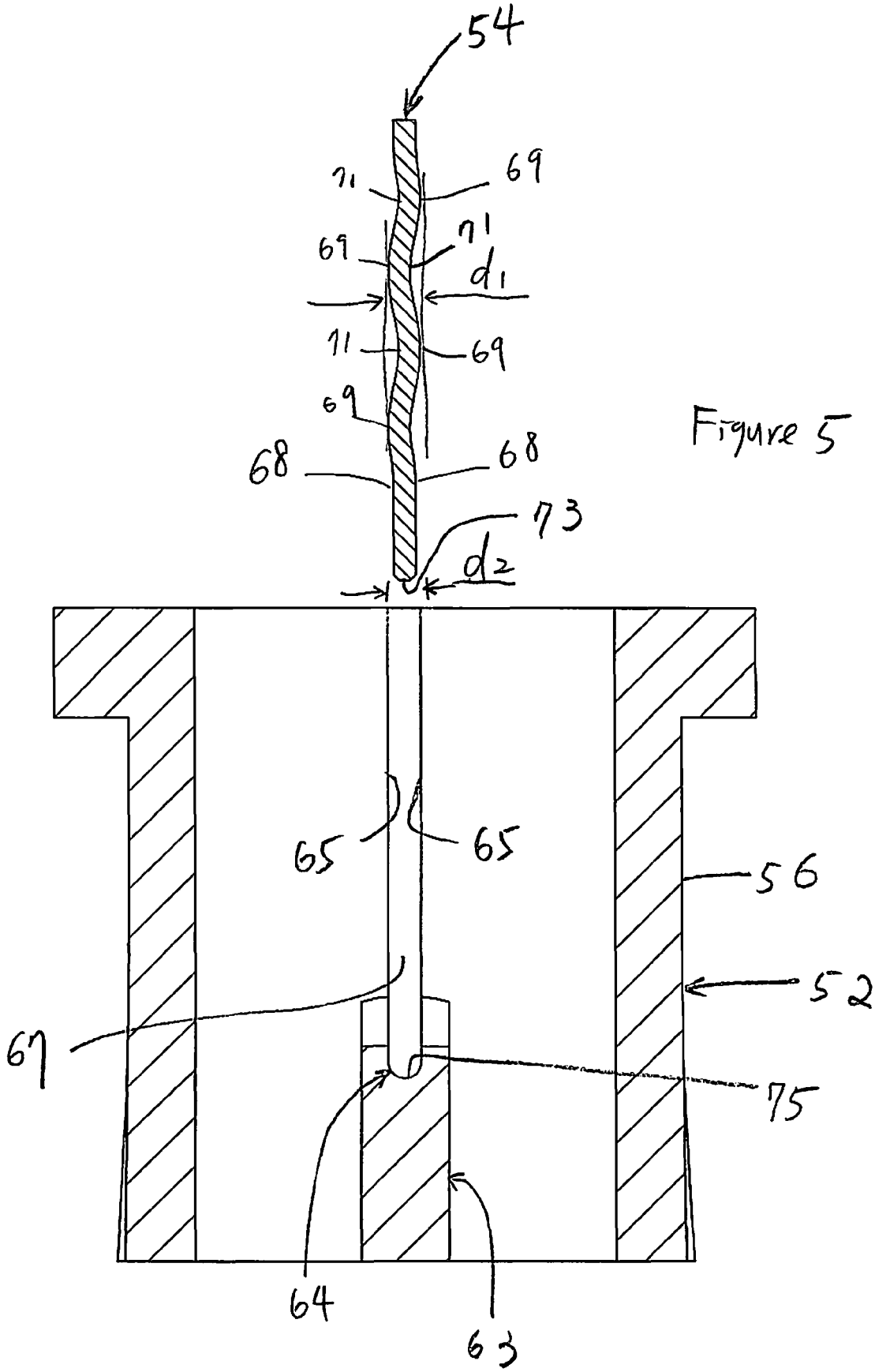
FIG. 5 is a cross-sectional, exploded view of an exhaust component assembly according to the first embodiment of the present disclosure.
Figure 6:
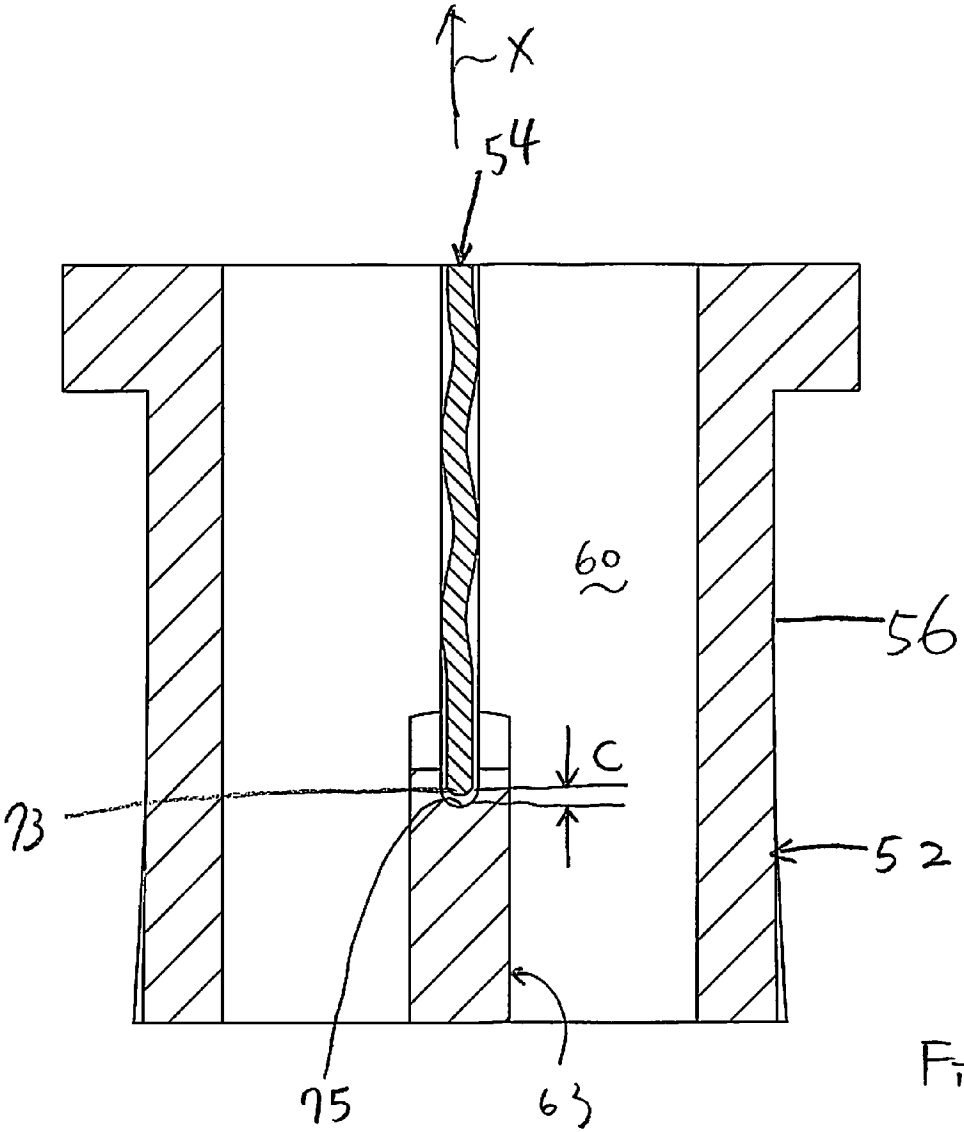
FIG. 6 is a cross-sectional view of an exhaust component assembly according to the first embodiment of the present disclosure.

Referring to FIGS. 4 to 6, an exhaust component assembly 50 according to a first embodiment of the present disclosure includes an exhaust component 52 and a divider plate 54. The exhaust component 52 is shown to be an exhaust manifold. Only an outlet portion 56 of the exhaust manifold is shown for clarity. The outlet portion 56 includes inner wall 58 that defines a gas passageway 60. A groove 62 is formed on the inner wall 58 and extend along the longitudinal direction X of the gas passageway 60. A flange 63 extends radially from the inner wall 58 within the gas passageway 60. The flange 63 defines a slot 64 which essentially is a continuation of the groove 62 formed in the inner wall 58. The slot 64 and groove 62 define a substantially U-shape receiving space.

The groove 62 is defined by a pair of opposing groove walls 65 that face one another and an end groove wall 67 that connects the opposing groove walls 65. The opposing groove walls 65 define a distance d2. The divider plate 54 includes a plurality of wavy surfaces 68 each defining crests 69 and valleys 71. The crests 69 on the opposing wavy surfaces 68 define a distance dl along a thickness direction of the divider plate 54. Distance d1 is slightly greater than the distance d2. When the divider plate 54 is inserted into the grooves 62, the wavy surfaces 68, particularly, the crests 69 on the wavy surfaces 68 are biased against the opposing groove walls 65. When the divider plate 54 is positioned in place, the biasing force of the divider plate 54 pushes the divider plate 54 against the groove walls 65 to lock the divider plate 54 in the groove 62. Therefore, the divider plate 54 and the groove 62, particularly the opposing groove walls 65 are engaged in an interference fit manner.

The lower portion of the groove 62 otherwise referred to herein as a slot 64 which receives the divider plate 54 is formed to allow for clearance C at least between the bottom edge 73 of the divider plate 54 and the slot 64. The clearance C may also be formed between the opposing groove walls 65 and the wavy surfaces 68 of the divider plate 54 adjacent to the slot 64. The clearances C provide room for thermal expansion of the exhaust component 52 and/or the divider plate 54 when the exhaust component assembly 50 is subjected to high temperature.

While not shown in the drawings, it is understood and appreciated that the divider plate 54 may include one wavy surface and one flat surface.

Figure 7:
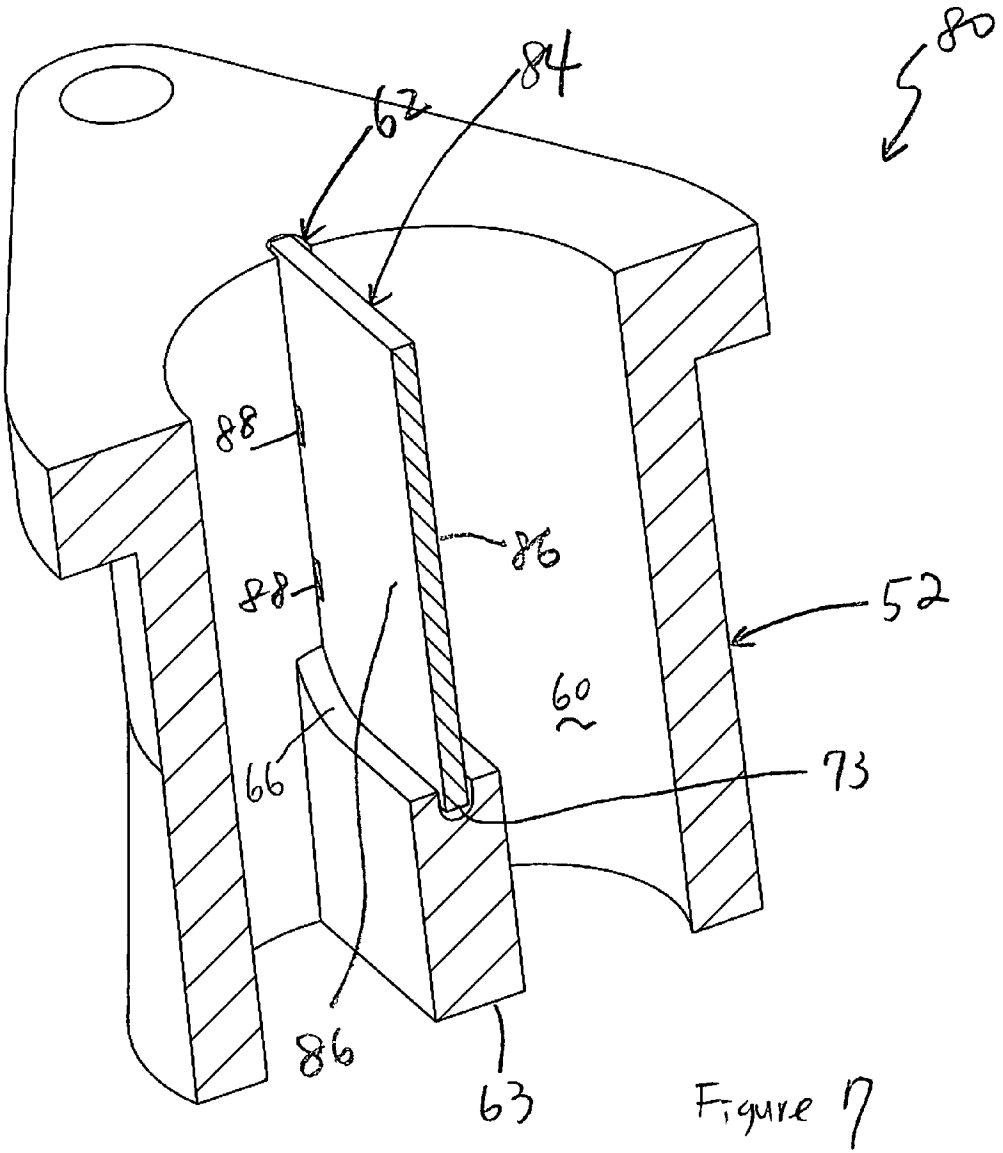
FIG. 7 is a perspective, cross-sectional view of an exhaust component assembly according to a second embodiment of the present disclosure.
Figure 8:
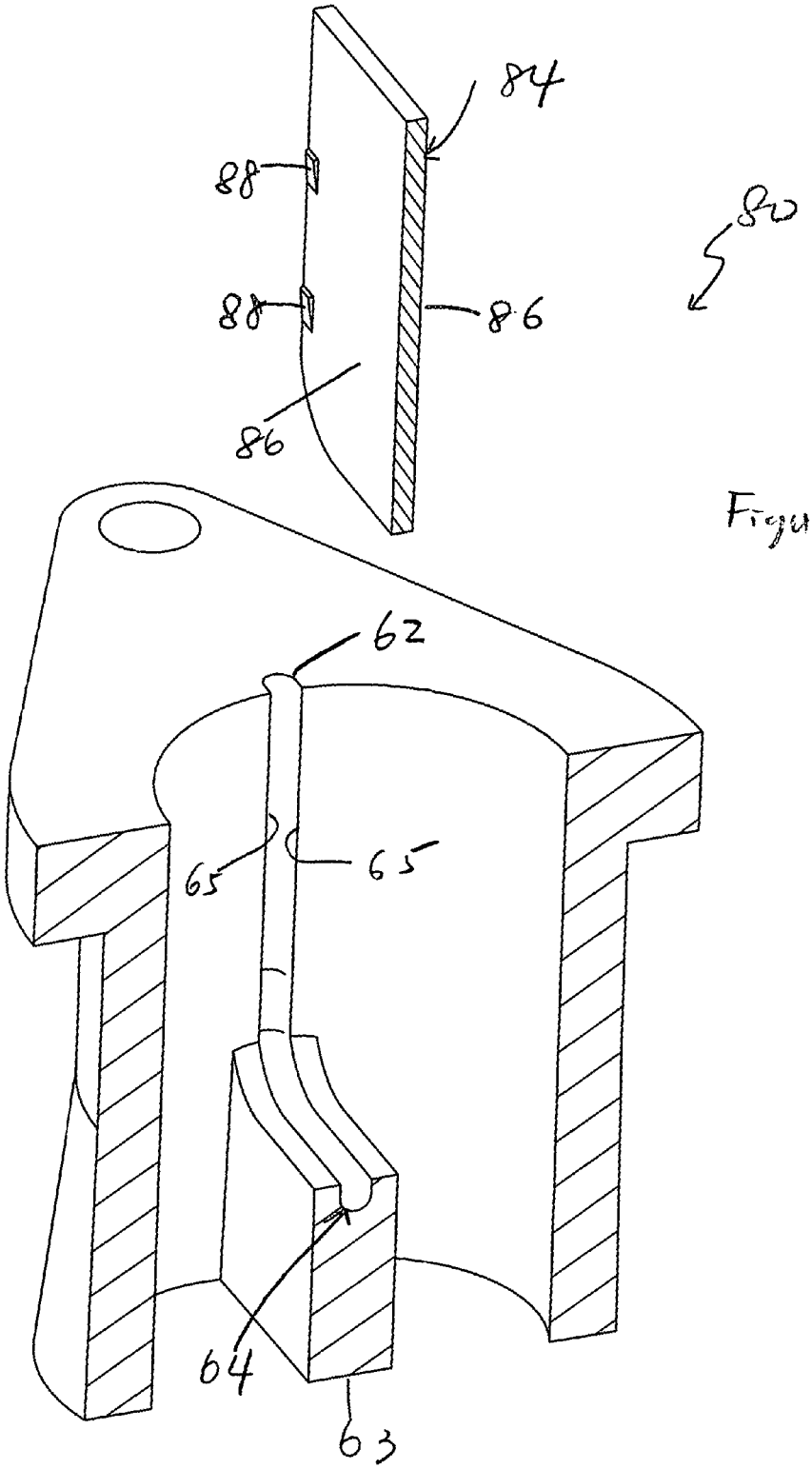
FIG. 8 is a perspective, cross-sectional, exploded view of an exhaust component assembly according to a second embodiment of the present disclosure.
Figure 9:
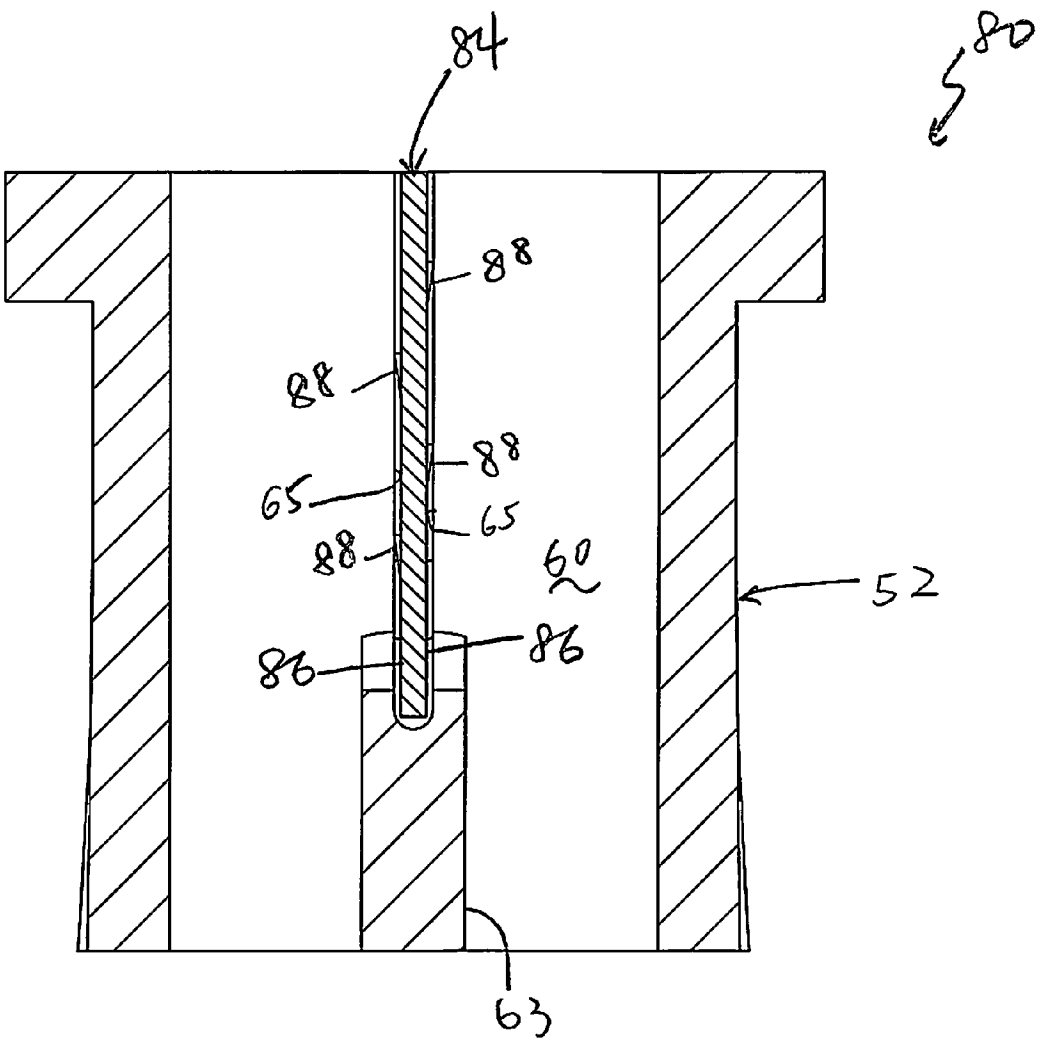
FIG. 9 is a cross-sectional view of an exhaust component assembly according to a second embodiment of the present disclosure.

Referring to FIGS. 7 to 9, an exhaust component assembly 80 according to a second embodiment of the present disclosure includes an exhaust component 52 and a divider plate 84. In the following, like components in different embodiments are indicated by like reference numerals. The divider plate 84 differs from the divider plate 54 of the first embodiment in that the divider plate 84 includes opposing flat surfaces 86 and a plurality of locking tabs 88 extending outwardly and upwardly from the opposing flat surfaces 86. "Upwardly" as used in the context of the locking tabs 88 means "away from the lead-in end of the divider plate 84. When the divider plate 84 is inserted into the groove 62, the locking tabs 88 are biased against the opposing groove walls 65. When the divider plate 84 is inserted in place, the biasing force of the locking tabs 88 locks the divider plate 84 in the groove 62 to achieve an interference fit. The locking tabs 88 may be formed by punching the divider plate 84 and bending the locking tabs 88 outwardly. The locking tabs 88 are alternately arranged and staggered on the flat surfaces 86 along the longitudinal direction X of the passageway 60.

It is understood and appreciated that while locking tabs 88 are shown to be provided on both flat surfaces 86 of the divider plate 84, the locking tabs 88 can be formed on only one flat surface 86.

Figure 10:
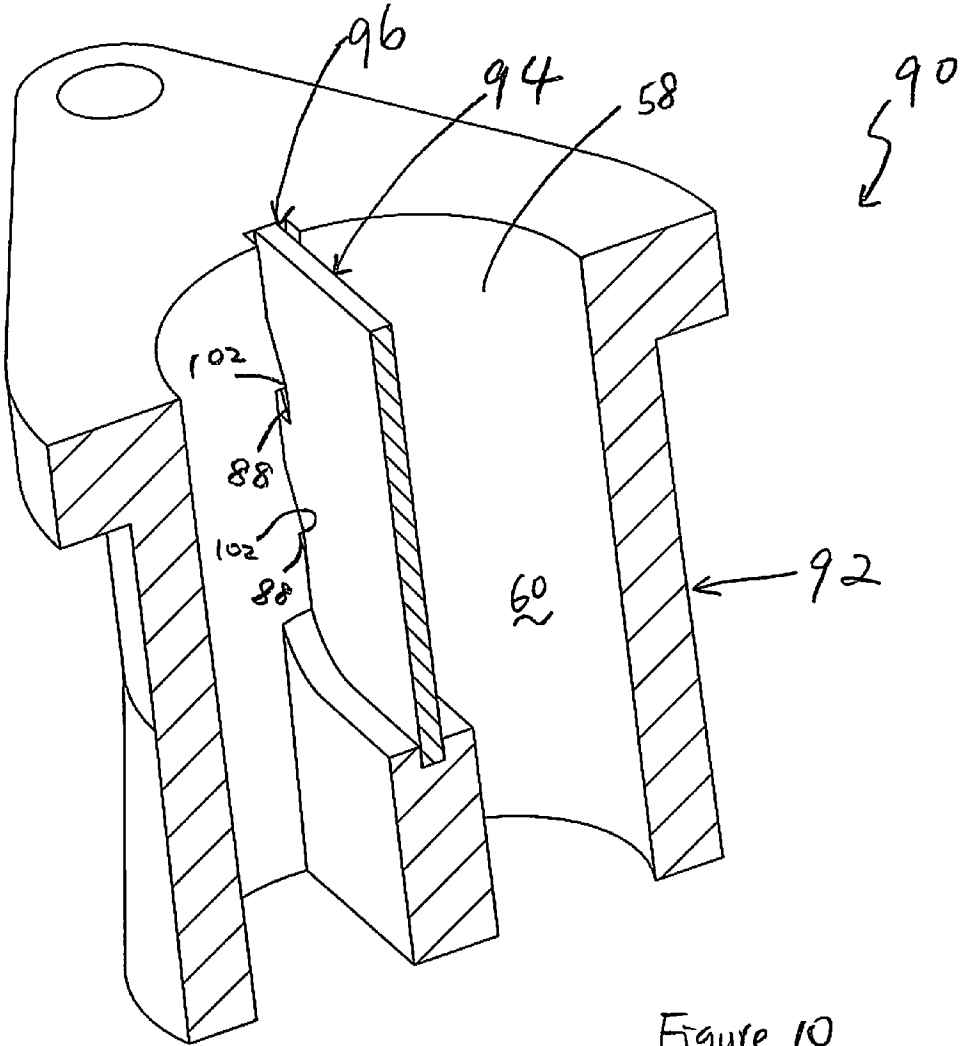
FIG. 10 is a perspective, cross-sectional view of an exhaust component assembly according to a third embodiment of the present disclosure.
Figure 11:
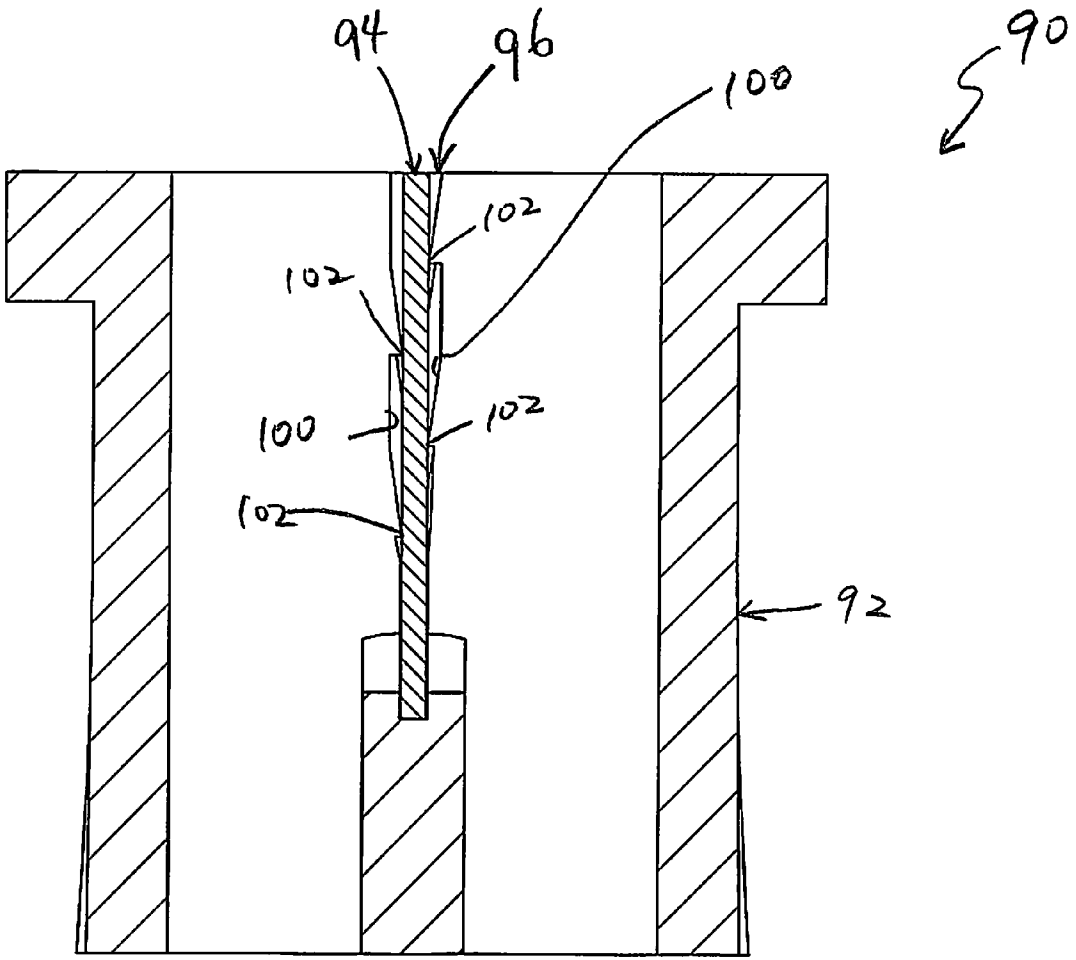
FIG. 11 is a cross-sectional view of an exhaust component assembly according to a third embodiment of the present disclosure.
Figure 12:
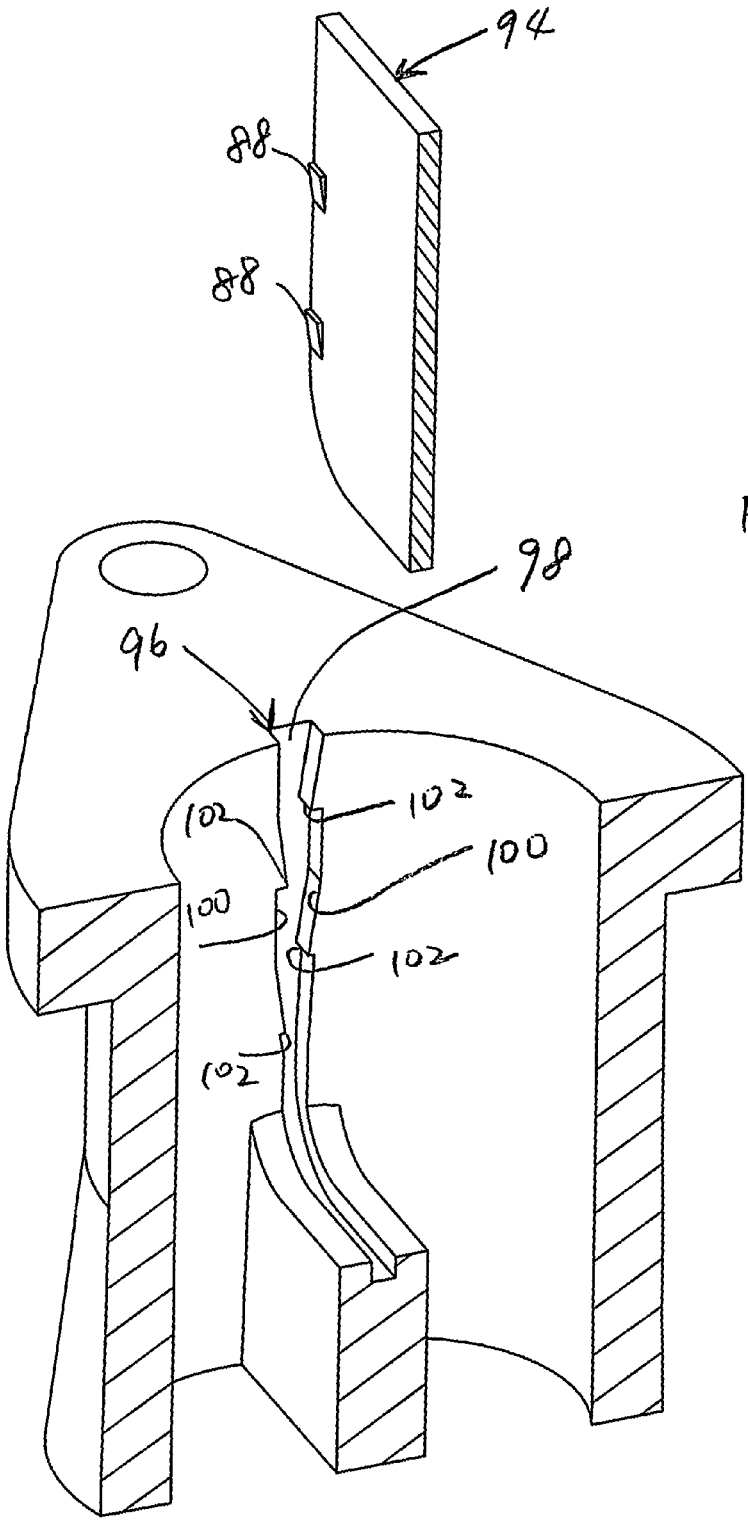
FIG. 12 is a perspective, cross-sectional, exploded view of an exhaust component assembly according to a third embodiment of the present disclosure.

Referring to FIGS. 10 to 12, an exhaust component assembly 90 according to a third embodiment of the present disclosure includes an exhaust component 92 and a divider plate 94. The divider plate 94 has a structure similar to that of the divider plate 54 of the second embodiment. The exhaust component 92 defines a groove 96 extending along an inner wall 58 that defines the gas passageway 60. The groove 96 is defined by an end wall 98 and opposing rugged groove walls 100. The opposing rugged groove walls 100 each define protrusions 102 extending toward the groove 96. The protrusions which may have varying shapes are shown as wedge-shaped protrusions 102. The protrusions 102 are provided to interfere with corresponding locking tabs 88. When the divider plate 94 is inserted in the groove 96, the locking tabs 88 are biased against the rugged groove walls 100. When the divider plate 94 is in place, the locking tabs 88 may return to their original un-biased or less-biased position and engage the wedge-shaped protrusions 102. As such, the divider plate 94 is securely locked in the grooves 96.

Figure 13:
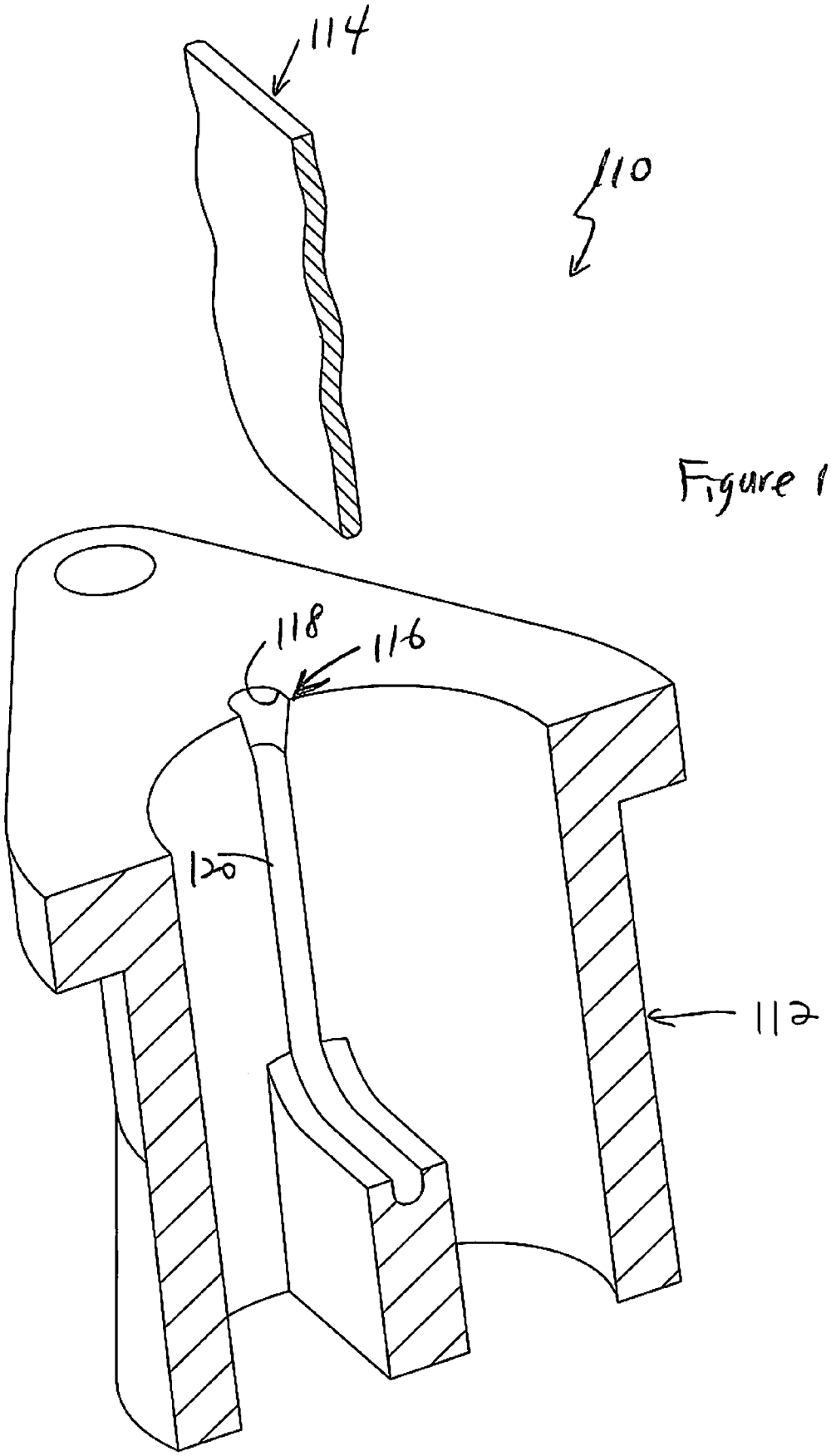
FIG. 13 is a perspective, cross-sectional, exploded view of an exhaust component assembly according to a fourth embodiment of the present disclosure.

Referring to FIG. 13, an exhaust component assembly 110 according to a fourth embodiment of the present disclosure includes an exhaust component 112 and a divider plate 114. The exhaust component assembly 110 is similar to that of the first embodiment except for the groove 116. The groove 116 has an enlarged portion 118 and a straight portion 120. The divider plate 114 engages the straight portion 120 of the groove 116. The enlarged portion 118 facilitates insertion of the divider plate 114 into the groove 116.

While not shown in the drawings, it is understood and appreciated that any of the grooves 62 and 96 of the first, second and third embodiment can be formed to have the enlarged portion 118 to facilitate insertion of the divider plates 54, 84, 94, 114 into the grooves 62 and 96.

The exhaust components assemblies according to the present disclosure incorporate divider plates to help absorb heat from the exhaust gas. The divider plates have mechanical features to enable the divider plates to be easily installed to the outlet portions of the exhaust manifolds and, depending on the embodiment, may be easily removed for replacement.

While the examples and discussion of the present disclosure generally relate to exhaust manifold outlet applications, it should be understood by those skilled in the art that the general concepts discussed herein are also applicable to other "exhaust components" such as turbocharger inlets. Additionally, while each of the embodiments depicted pertain to cast manifold applications, it should also be recognized that the divider plate may be used in fabricated exhaust systems.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. An exhaust component assembly comprising:

an exhaust component that includes an inner wall defining a gas passageway, said inner wall including at least one recessed groove; and a divider plate inserted into the groove and secured to the exhaust component by mechanical locking means occurring between the divider plate and said at least one groove, wherein the mechanical locking means includes an interference fit between the divider plate and the exhaust component, wherein the divider plate includes a locking feature for locking the divider plate in the exhaust component, and wherein the locking feature includes at least one wavy surface for engaging a groove wall occurring along said at least one groove.

2. The exhaust component assembly of claim 1, wherein the at least one groove includes an enlarged portion at a lead-in end.

3. The exhaust component assembly of claim 1, wherein the locking feature is integrally formed with the divider plate.

4. The exhaust component assembly of claim 1, wherein the locking feature includes a plurality of wavy surfaces for engaging the groove wall.

5. The exhaust component assembly of claim 1, wherein the divider plate is formed from a high temperature material.

6. The exhaust component assembly of claim 5, wherein the high temperature material is selected from ceramics and stainless steel.

7. An exhaust component assembly comprising:

an exhaust component that includes an inner wall defining a gas passageway, said inner wall including at least one recessed groove; and a divider plate inserted into the groove and secured to the exhaust component by mechanical locking means occurring between the divider plate and said at least one groove, wherein the mechanical locking means includes an interference fit between the divider plate and the exhaust component, wherein the divider plate includes a locking feature for locking the divider plate in the exhaust component, wherein the locking feature includes locking tabs extending from at least one surface of the divider plate, and wherein the locking tabs engage at least one rugged groove wall that defines the at least one groove.

8. The exhaust component assembly of claim 7, wherein the at least one surface is a flat surface.

9. The exhaust component assembly of claim 7, wherein the at least one rugged groove wall defines protrusions for interfering with the locking tabs.

10. The exhaust component assembly of claim 9, wherein the protrusions are wedge shaped.

11. An exhaust component assembly comprising:

an inlet portion;

an outlet portion defining an inner wall, a gas passageway defined by the inner wall, and at least one groove formed on the inner wall;

a plurality of runners converging at said gas passageway; and a divider plate inserted into at least one groove so as to separate the gas passageway into compartments;

wherein the divider plate includes a locking feature for locking the divider plate to groove walls that define the at least one groove, wherein the locking feature includes at least one wavy surface for engaging the groove walls.

12. The exhaust component assembly of claim 11, wherein the locking feature is integrally formed with the divider plate.

13. The exhaust component assembly of claim 11, wherein the locking feature includes a plurality of wavy surfaces for engaging the groove wall.

14. The exhaust component assembly of claim 11, wherein the locking feature includes locking tabs extending from at least one surface of the divider plate.

15. The exhaust component assembly of claim 14, wherein the locking tabs engage at least one rugged groove wall that defines the at least one groove.

16. The exhaust component assembly of claim 15, wherein the at least one rugged groove wall defines protrusions for interfering with the locking tabs.

17. The exhaust component assembly of claim 16, wherein the protrusions are wedge shaped.

18. The exhaust component assembly of claim 11, wherein the divider plate is formed from a high temperature material.

19. The exhaust component assembly of claim 18, wherein the high temperature material is selected from ceramics and stainless steel.

* * * * *